US012577774B2

(12) United States Patent
Qin et al.

(10) Patent No.: US 12,577,774 B2
(45) Date of Patent: Mar. 17, 2026

(54) MODULAR COLLAPSIBLE BUILDING FRAMES

(71) Applicant: A&C Future Inc., Newport Beach, CA (US)

(72) Inventors: Han Qin, Newport Beach, CA (US); Jiuqi Wang, Santa Ana, CA (US); Zhuangboyu Zhou, Santa Ana, CA (US); Sichen Li, Santa Ana, CA (US); Keguan Zou, Irvine, CA (US); Jiayang Qin, Newport Beach, CA (US)

(73) Assignee: A&C Future Inc., Irvine, CA (US)

( * ) Notice: Subject to any disclaimer, the term of this patent is extended or adjusted under 35 U.S.C. 154(b) by 620 days.

(21) Appl. No.: 17/858,898

(22) Filed: Jul. 6, 2022

(65) Prior Publication Data

US 2024/0011279 A1 Jan. 11, 2024

(51) Int. Cl.
*E04B 1/344* (2006.01)
*E04B 1/18* (2006.01)
*E04B 1/348* (2006.01)

(52) U.S. Cl.
CPC ..... *E04B 1/3441* (2013.01); *E04B 1/18* (2013.01); *E04B 1/34815* (2013.01)

(58) Field of Classification Search
CPC ..... E04B 1/18; E04B 1/34331; E04B 1/3441; E04B 1/3445; E04B 1/34815; E04B 1/3483; E04B 1/34384
USPC ..... 52/79.5
See application file for complete search history.

(56) References Cited

U.S. PATENT DOCUMENTS

| | | | | |
|---|---|---|---|---|
| 3,184,012 | A * | 5/1965 | Ishimoto | E04B 1/35 52/646 |
| 3,774,356 | A | 11/1973 | Philp | |
| 5,444,944 | A | 8/1995 | Roelofsz | |
| 6,158,187 | A * | 12/2000 | Nakajima | E04B 1/3441 52/645 |
| 8,997,409 | B1 * | 4/2015 | Lashley | E04D 3/366 52/468 |
| 10,753,079 | B2 * | 8/2020 | Rulquin | E04B 1/3431 |
| 11,396,444 | B2 * | 7/2022 | Cui | B66C 23/64 |
| 11,767,665 | B1 * | 9/2023 | Qin | E04C 2/46 52/483.1 |
| 12,163,327 | B2 * | 12/2024 | Bowron | E04B 1/2403 |
| 2004/0231256 | A1 * | 11/2004 | Ohnishi | E04B 1/3483 52/236.7 |

(Continued)

FOREIGN PATENT DOCUMENTS

| | | | | |
|---|---|---|---|---|
| DE | 102011121207 | A1 * | 6/2013 | B66F 7/0666 |
| EP | 2535470 | A1 * | 12/2012 | E04B 1/24 |

(Continued)

*Primary Examiner* — Christine T Cajilig
(74) *Attorney, Agent, or Firm* — Joseph A. Andelin; Fish IP Law, LLP

(57) ABSTRACT

Collapsible building frame modules having first and second frame components are contemplated. One or more cross-link beams couple the first and second frame components. It is contemplated that the one or more cross-link beams slide along a frame component on one end and rotate with respect to a different frame component on an opposite end to thereby fold or unfold a building frame module. One or more building frame modules can be horizontally or vertically stacked to form a building frame or a portion of a building frame.

18 Claims, 13 Drawing Sheets

(56) References Cited

U.S. PATENT DOCUMENTS

| | | | | |
|---|---|---|---|---|
| 2005/0210764 | A1* | 9/2005 | Foucher | E04B 1/3445 52/79.5 |
| 2006/0156684 | A1 | 7/2006 | Foucher | |
| 2014/0157714 | A1* | 6/2014 | Richardson | E04B 1/1903 52/646 |
| 2018/0106031 | A1* | 4/2018 | Coombes | E04B 1/3441 |
| 2022/0251824 | A1* | 8/2022 | Pacarada | F16B 7/0446 |
| 2023/0095414 | A1* | 3/2023 | Lippert | E04B 1/3445 52/79.5 |
| 2024/0133200 | A1* | 4/2024 | Savard | E04B 1/3205 |

FOREIGN PATENT DOCUMENTS

| | | | |
|---|---|---|---|
| JP | 5748756 | B2 | 9/2009 |
| WO | 2011038145 | | 3/2011 |
| WO | 2012045008 | | 4/2012 |
| WO | 2012094766 | | 7/2012 |

* cited by examiner

MODULAR COLLAPSIBLE BUILDING FRAMES

FIELD OF THE INVENTION

The field of the invention is building frames, and more specifically, building frame modules used to construct building frames.

BACKGROUND

The background description includes information that may be useful in understanding the present invention. It is not an admission that any of the information provided herein is prior art or relevant to the presently claimed invention, or that any publication specifically or implicitly referenced is prior art.

Building frame construction often involves the framing of a building (e.g., a house) on a foundation that has already been constructed. The frame components or modules that make up a building frame are usually transported by a truck to a destination and then craned one by one to their assigned position. The process of aligning beams and columns of frame components or modules is tedious and time-consuming. In addition, a high amount of labor is involved to facilitate the operation of the crane.

Foldable, prefabricated building frame modules have been contemplated. For example, Richardson (PCT Publication No. WO 2012/094766) and Philip (U.S. Pat. No. 3,774,356) disclosed building frame modules or components that are foldable. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Although building frame modules exist, there is still a need for improved building frame modules.

SUMMARY OF THE INVENTION

The inventive subject matter provides apparatus, systems, and methods in which building frame modules are designed to be collapsible, which allow the modules to be mass-produced, easily transported, and easily installed to form a building frame. A contemplated building frame module comprises first and second frame components. The module further comprises a cross-link beam that is (i) rotatably coupled to the first frame component and (ii) slidably coupled to the second frame component. The cross-link beam rotates with respect to the first frame component and slides along a portion of the second frame component to collapse the first and second frame components onto one another and thereby fold the building frame module.

The building frame module can further comprise a second cross-link beam that is (i) slidably coupled to the first frame component and (ii) rotatably coupled to the second frame component to further assist in transitioning between folded and unfolded configurations of the building frame module. It is contemplated that the first and/or second frame components comprise one or more tracks on which one or more of the cross-link beams slides as the building frame module is folded or unfolded. Furthermore, the one or more of the cross-link beams can be coupled to one or more hydraulic cylinders to assist in rotation of the one or more cross-link beams with respect to the first and/or second frame components.

In another aspect, a module building frame system is contemplated. The system comprises first and second building frame modules that can be horizontally or vertically stacked. The first and second building frame modules each comprise first and second frame components and a cross-link beam rotatably coupled to the first frame component and slidably coupled to the second frame component to thereby fold or unfold the first and second building frame modules. Once horizontally or vertically stacked, a coupling couples the first building frame module and the second building frame module.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The inventors have discovered building frame modules that reduce the time, labor, and effort in constructing a building frame compared to conventional construction methods. In terms of production, the manufacturing process of all parts of the contemplated building frame modules can be automated, which can significantly reduce production costs and increase production efficiency and capacity. In addition, since the building frame modules do not need to be fabricated at the construction site, its construction is not affected by inclement weather, thus increasing construction efficiency.

Furthermore, contemplated building frame modules can be folded or unfolded. This feature maximizes the efficiency of transportation of contemplated building frame modules. It is contemplated that hydraulic rods and other power elements can be used to assist in the folding or unfolding actions. Once the building frame modules are installed, the hydraulic rods and other power elements can be removed. It should be appreciated that contemplated building frame modules can be treated like any other building frame, such that the building frame modules can be fitted in reserved positions of beams and columns of conventional frames for houses, walls, floors, and ceilings.

Figure 1A:
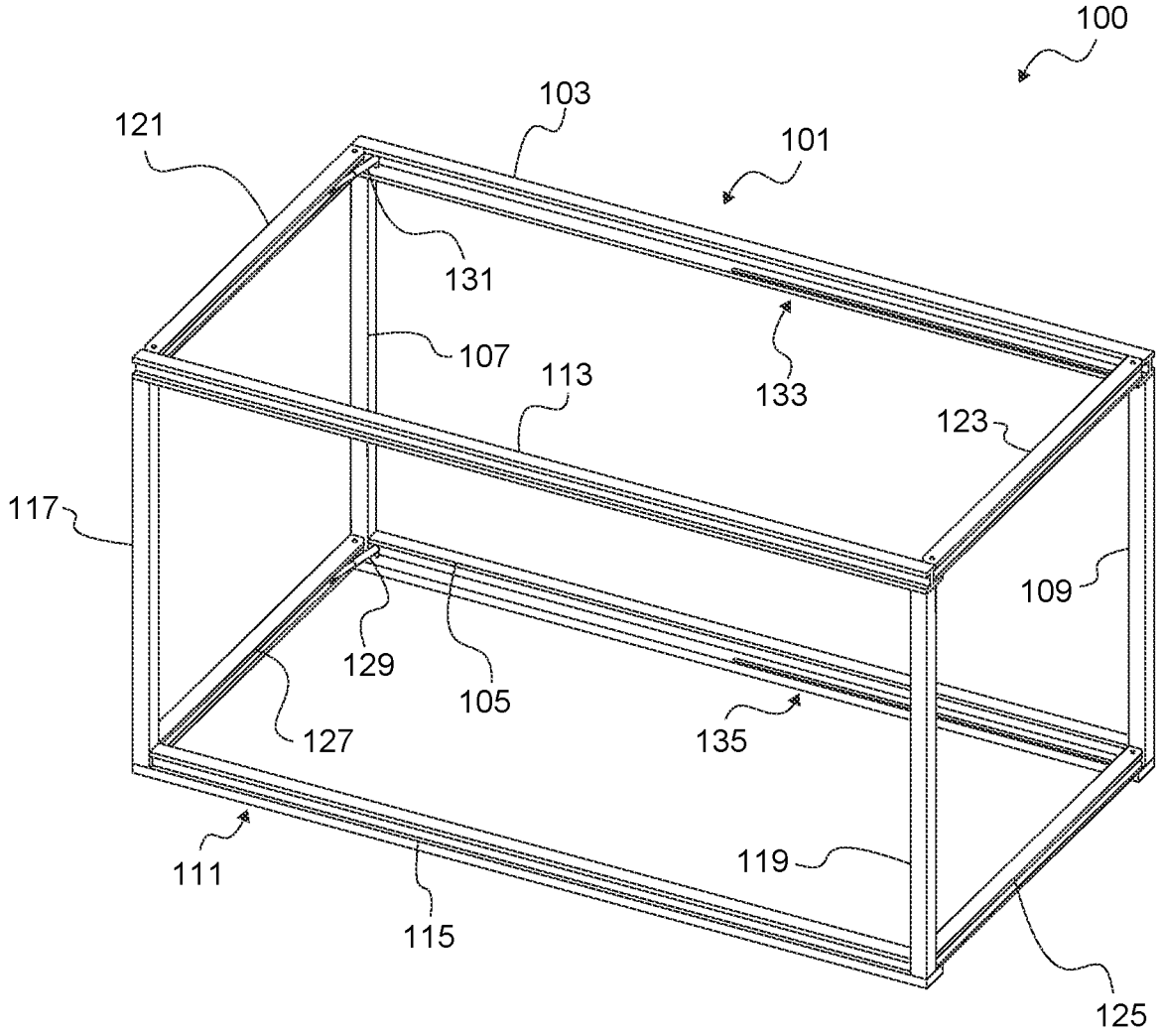
FIG. 1A is a perspective view of an embodiment of a building frame module.

FIG. 1A shows an embodiment of a building frame module 100. Building frame module 100 comprises a first frame component 101 and a second frame component 111. First frame component 101 comprises a first beam 103 and a second beam 105 coupled to a first column 107 and a second column 109. Second frame component 111 comprises a first beam 113 and a second beam 115 coupled to a first column 117 and a second column 119. First frame component 101 and second frame component 111 are coupled via a plurality of cross-link beams, such as a first cross-link beam 121, a second cross-link beam 123, a third cross-link beam 125, and a fourth cross-link beam 127 as shown in FIG. 1A.

The plurality of cross-link beams can rotate to fold or unfold building frame module 100. It is contemplated that building frame module 100 can be (i) manufactured at a separate facility from the construction site, (ii) transported in a folded configuration to save on transportation costs, and (iii) simply unfolded at the construction site for installation, which reduces time, labor, and effort in constructing the building frame for the reasons described above. It is contemplated that the plurality of cross-link beams (i) rotate with respect to first frame component 101 or second frame component 111 and (ii) slide with respect to first frame component 101 or second frame component 111 to thereby move first frame component 101 and second frame component 111 toward or away one another and fold or unfold building frame module 100.

Figure 1B:
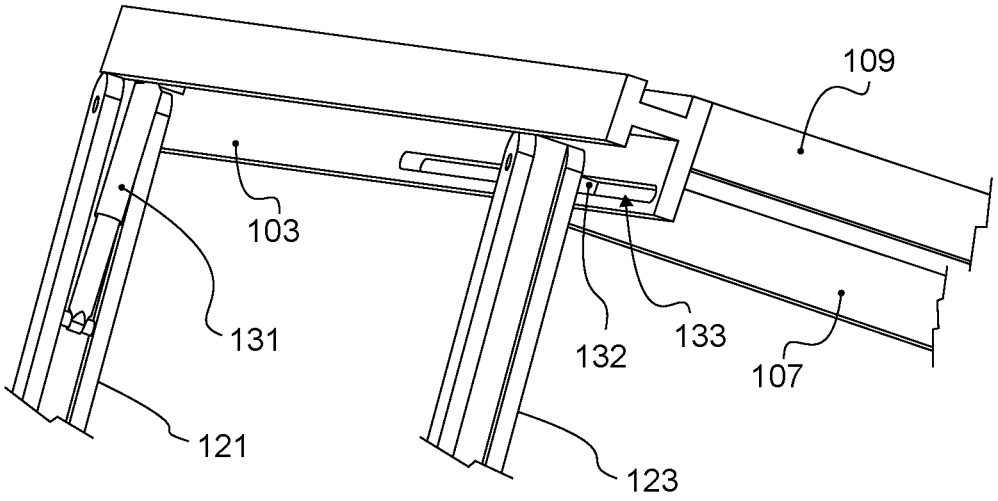
FIGS. 1B-1C are enlarged views of a portion of the building frame module of FIG. 1A.
Figure 1C:
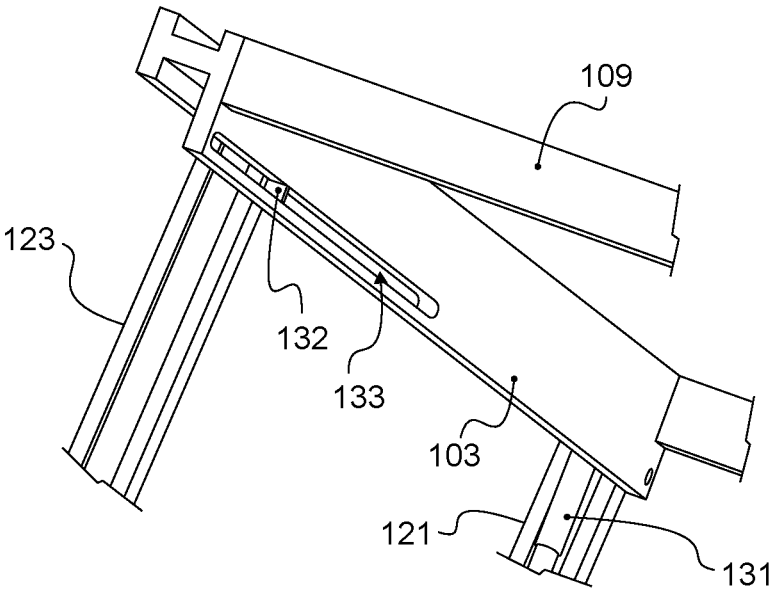

As shown in FIG. 1A, first frame component 101 comprises a first track 133 disposed on first beam 103 and a second track 135 disposed on second beam 105. Second cross-link beam 123 comprises a track element (e.g., a wheel, a rotatable projection, a non-rotatable projection, etc.) that moves within first track 133, and third cross-link beam 125 comprises a track element (e.g., a wheel, a rotatable projection, a non-rotatable projection, etc.) that moves within second track 135. FIGS. 1B-1C show a track element 132 of second cross-link beam 123 within first track 133. As shown, track element 132 is a projection and first track 133 is a slot. It is contemplated that the projection can rotate to move within the slot, or the projection is non-rotatable and slides along the slot.

On an opposite end, second cross-link beam 123 and third cross-link beam 125 are rotatably coupled to second frame component 111. As shown in FIG. 1A, second cross-link beam 123 is rotatably coupled to first beam 113 and third cross-link beam 125 is rotatably coupled to second beam 115.

Although not shown, it is contemplated that second frame component 111 comprises a first track disposed on first beam 113 and a second track disposed on second beam 115. First cross-link beam 121 comprises a track element (e.g., a wheel, a rotatable projection, a non-rotatable projection, etc.) that moves within the first track of second frame component 111, and fourth cross-link beam 127 comprises a track element (e.g., a wheel, a rotatable projection, a non-rotatable projection, etc.) that moves within the second track of second frame component 111. On an opposite end, first cross-link beam 121 and fourth cross-link beam 127 are rotatably coupled to first frame component 101. As shown in FIG. 1A, first cross-link beam 121 is rotatably coupled to first beam 103 and fourth cross-link beam 127 is rotatably coupled to second beam 105.

The folding and unfolding of building frame module 100 can be aided by hydraulic rods and other power elements. For example, building frame module 100 comprises a first hydraulic rod 131 coupled to first cross-link beam 121 and first beam 103 of first frame component 101, and a second hydraulic rod 129 coupled to fourth cross-link beam 127 and second beam 105 of first frame component 101. The rotation of first cross-link beam 121 and fourth cross-link beam 127 to unfold building frame module 100 can be aided by force provided by first hydraulic rod 131 and second hydraulic rod 129, respectively.

It is contemplated that building frame module 100 further comprises a third hydraulic rod and a fourth hydraulic rod. The third hydraulic rod can be coupled to second cross-link beam 123 and first beam 113 of second frame component 111, and the fourth hydraulic rod can be coupled to third cross-link beam 125 and second beam 115 of second frame component 111. The rotation of second cross-link beam 123 and third cross-link beam 125 to unfold building frame module 100 can be aided by force provided by the third hydraulic rod and the fourth hydraulic rod, respectively.

As building frame module 100 is folded, first cross-link beam 121, second cross-link beam 123, third cross-link beam 125, and fourth cross-link beam 127 slide on one end and rotate on an opposite end, with the assistance of hydraulic rods (e.g., first hydraulic rod 131, etc.). As discussed above, the ability to fold building frame module 100 saves on transportation costs. Furthermore, building frame 100 can be easily unfolded, such that first cross-link beam 121, second cross-link beam 123, third cross-link beam 125, and fourth cross-link beam 127 slide on one end and rotate on an opposite end, with the assistance of hydraulic rods (e.g., first hydraulic rod 131, etc.). Thus, as discussed above, labor costs to construct a building frame are reduced. It should be appreciated that building frame modules, such as building frame module 100, can be mass produced to control manufacturing costs.

Figure 2A:
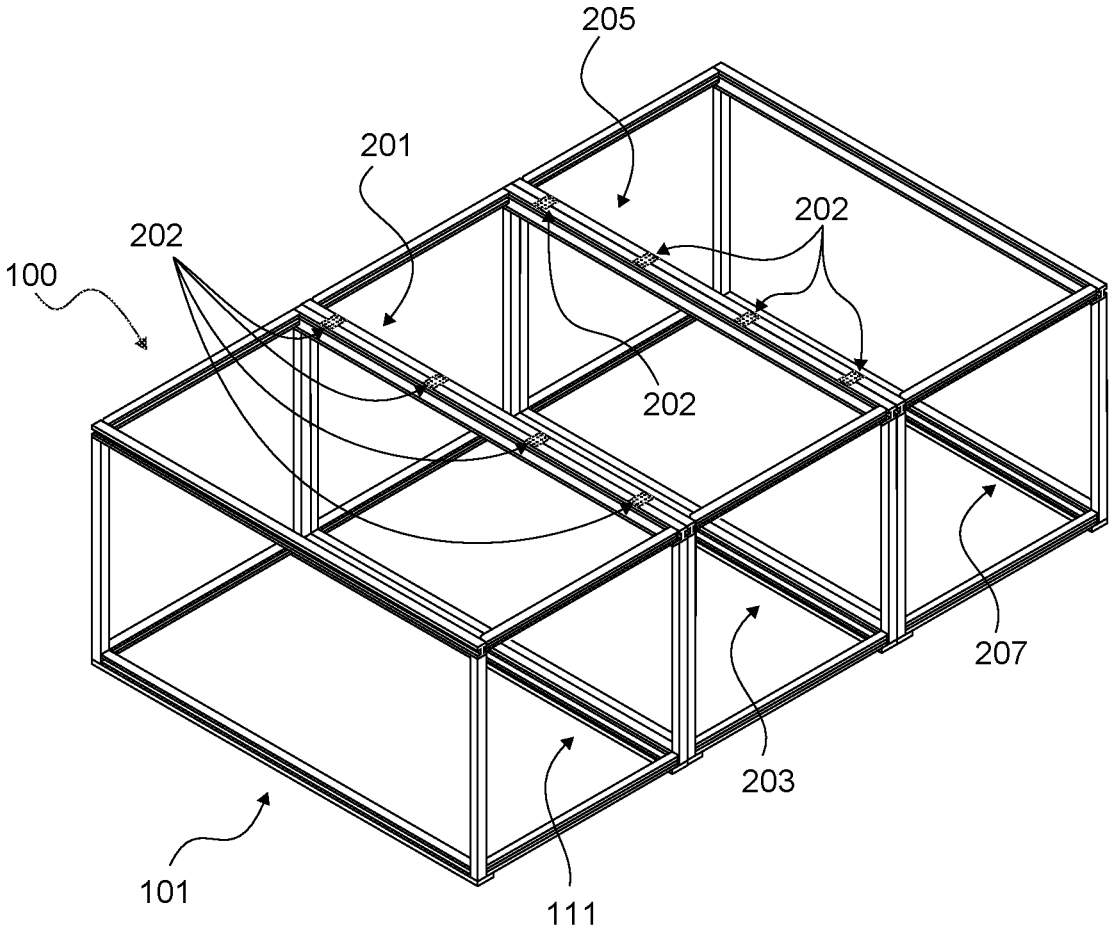
FIG. 2A is a perspective view of a plurality of building frame modules, including the building frame module of FIG. 1A, horizontally stacked in an unfolded configuration.
Figure 2B:
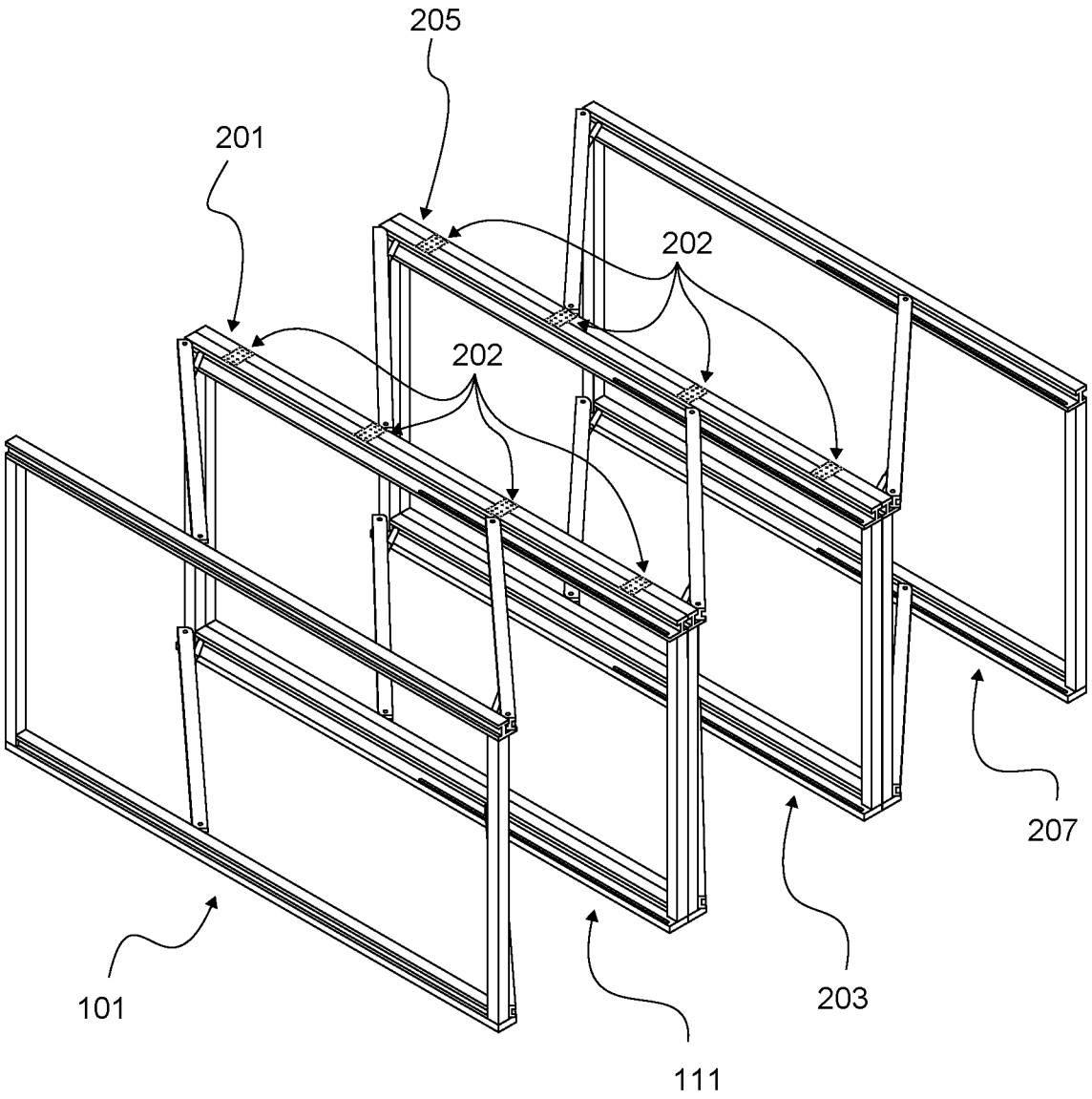
FIG. 2B is a perspective view of the plurality of building frame modules of FIG. 2A in a partially folded configuration.
Figure 2C:
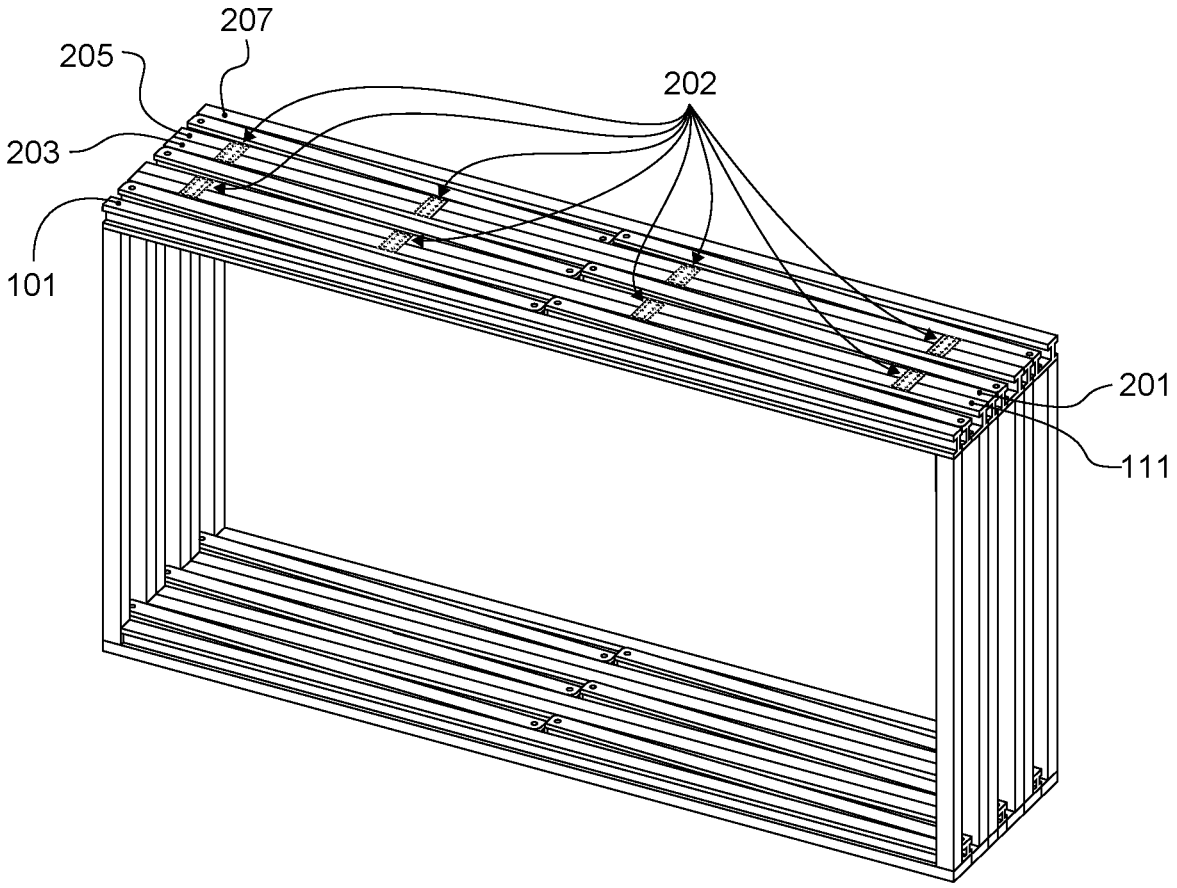
FIG. 2C is a perspective view of the plurality of building frame modules of FIG. 2A in a folded configuration.

The transition between the folded and unfolded configurations of building frame module 100 are shown in FIGS. 2A-2C. FIG. 2A shows building frame module 100 in an unfolded configuration, in which first frame component 101 is spaced apart from second frame component 111. FIG. 2B shows building frame module 100 in a partially folded configuration. The space between first frame component 101 and second frame component 111 is reduced as the plurality of cross-link beams are rotated on one end and slid on another end. FIG. 2C shows building frame module 100 in a folded configuration. The space between first frame component 101 and second frame component 111 is much smaller. It should be appreciated that the plurality of cross-link beams can rotate on one end and slide on another end to transition building frame module 100 from the folded configuration shown in FIG. 2C to the unfolded configuration shown in FIG. 2A.

It is contemplated that a plurality of building frame modules can be stacked vertically or horizontally to form a building frame. For example, FIGS. 2A-2C show three building frame modules that are horizontally stacked to form a portion of a building frame. As shown in FIGS. 2A-2C, building frame module 100 can abut a second building frame module having a first frame component 201 and a second frame component 203, and the second building frame module can abut a third building frame module having a first frame component 205 and a second frame component 207. The three building frame modules can each fold and unfold as shown in FIGS. 2A-2C.

Figure 2D:
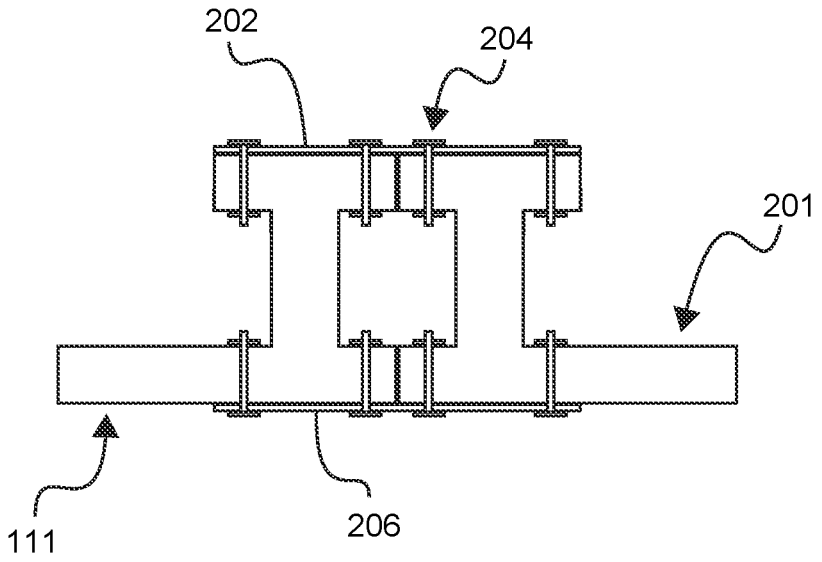
FIG. 2D is a cross-sectional view showing first and second plates coupling building frame modules of the plurality of building frame modules of FIG. 2A.
Figure 2E:
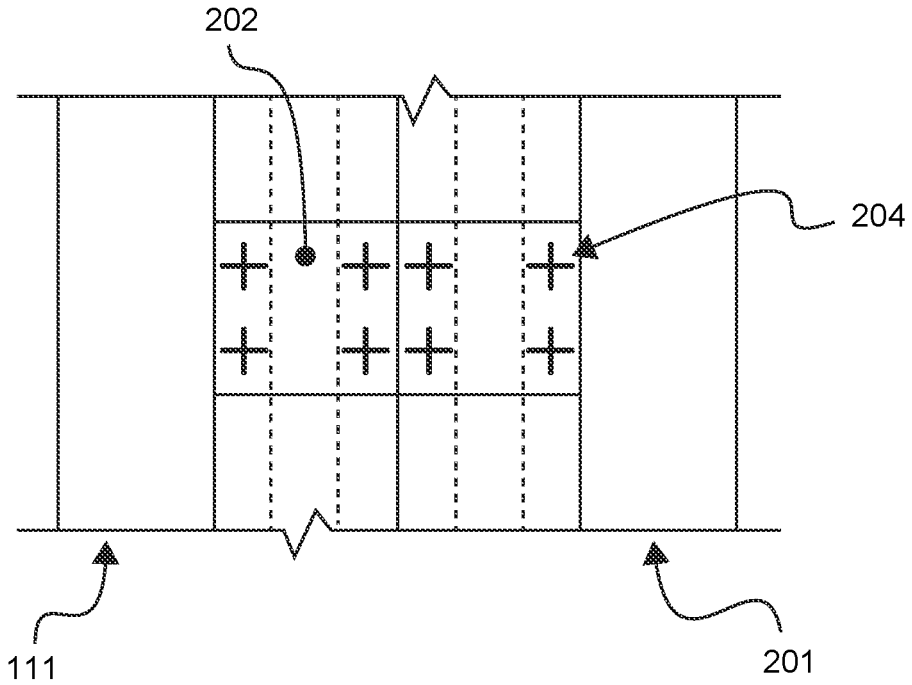
FIG. 2E is a top view showing the first plate of FIG. 2D coupling building frame modules of the plurality of building frame modules of FIG. 2A.

It is further contemplated that the horizontally stacked building frame modules can connect to one another. For example, one or more plates 202 (e.g., a steel plate) can be fastened to frame components of abutting building frame modules to connect the modules to one another as shown in FIGS. 2A-2C. FIG. 2D shows a cross-sectional view at a junction in which second frame component 111 of building frame module 100 abuts first frame component 201 of the second building frame module, and a plate 202 is fastened to top surfaces of second frame component 111 and first frame component 201 via one or more fasteners 204. FIG. 2E shows a top view showing the location of the one or more fasteners 204.

It is contemplated that a second plate 206 can be fastened to bottom surfaces of second frame component 111 and first frame component 201 via one or more fasteners to further secure the connection between building frame module 100 and the second building frame module. It should be appreciated that a second plate, as shown in FIG. 2D, can be coupled at all junctions where one or more plates 202 are shown in FIGS. 2A-2C.

Figure 3A:
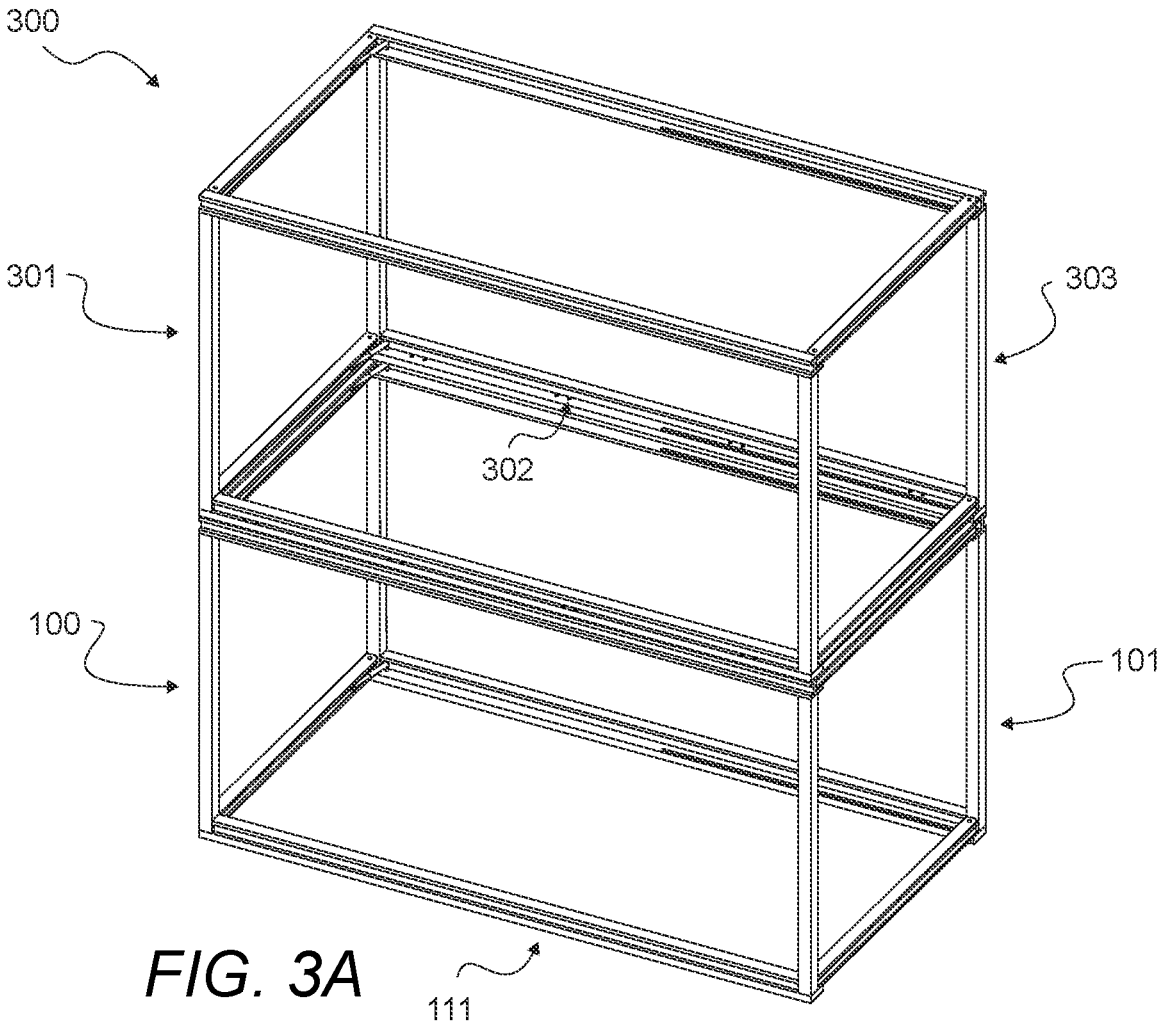
FIG. 3A is a perspective view showing first and second building frame modules, including the building frame module of FIG. 1A, vertically stacked in an unfolded configuration.

The building frame modules can also be stacked vertically to form a building frame or a portion of a building frame for a multi-story building as shown in FIG. 3A. FIG. 3A shows a second building frame module 300 vertically stacked onto building frame module 100. Second building frame module 300 comprises a first frame component 301 and a second frame component 303 coupled by cross-link beams. As shown in FIG. 3A, the bottom beams of second building frame module 300 align with the top beams of building frame module 100 to vertically stack the two building frame modules. Similar to the horizontally stacked building frame modules shown in FIGS. 2A-2C, it is contemplated that building frame module 100 and second building frame module 300 can fold or unfold.

Figure 3B:
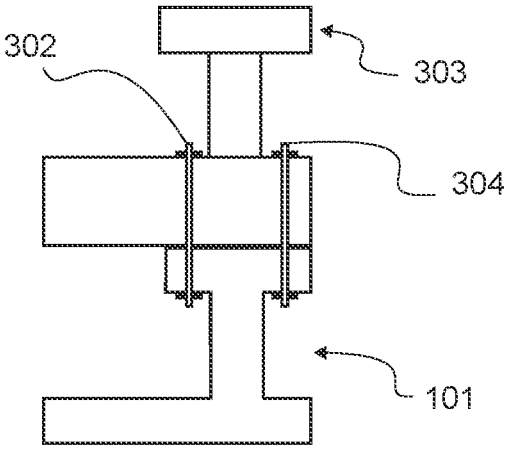
FIG. 3B is a cross-sectional view showing first and second fasteners coupling the first and second building frame modules of FIG. 3A.

Once stacked, it is contemplated that one or more fasteners can be used to secure the connection between the two building frame modules. FIG. 3B shows a cross-sectional view at a junction in which second frame component 303 of second building frame module 300 is stacked onto first frame component 101 of building frame module 100. As shown in FIG. 3B, a first fastener 302 and a second fastener 304 extend through a portion of each of second frame component 303 and first frame component 101 to couple building frame module 100 and second building frame module 300. It is contemplated that one or more fasteners can extend at various points in which second building frame module 300 is stacked onto building frame module 100 to further secure the connection between building frame module 100 and second building frame module 300.

Figure 4A:
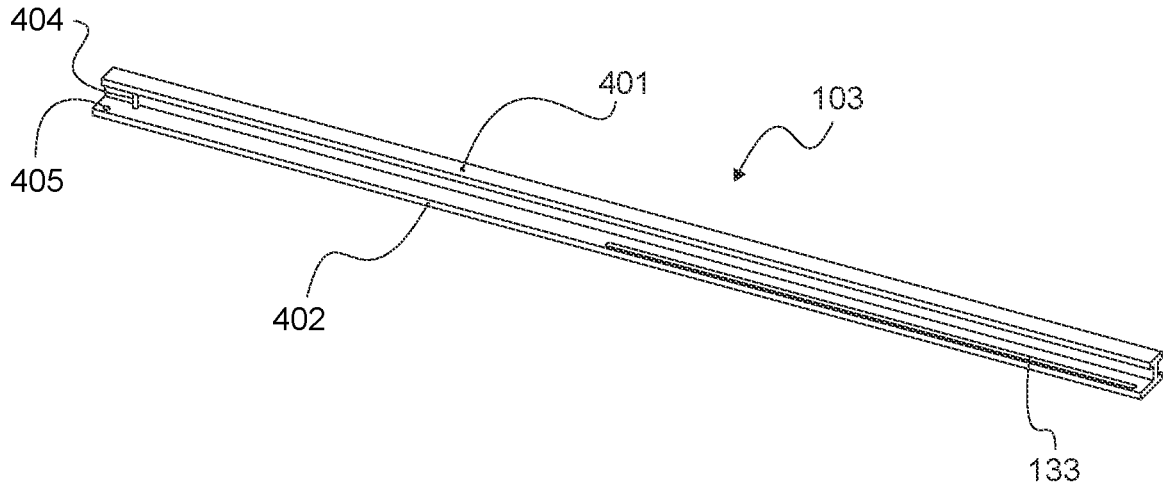
FIG. 4A is a perspective view of the first beam of the first frame component of FIG. 1A.
Figure 4B:
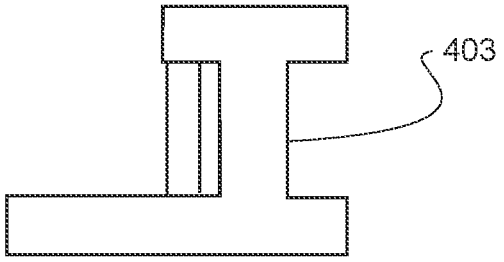
FIG. 4B is an end view of the first beam of FIG. 4A.

Various components of building frame module 100 will be described in further detail below. Different views of first beam 103 are shown in FIGS. 4A-4B. As shown in FIG. 1A, first beam 103 is disposed on a top of building frame module 100. First beam 103 has a modified I-beam shape. First beam 103 comprises a top flange 401, a bottom flange 402 that is wider than top flange 401 (see widths in FIG. 4B), and a web 403 that extends between top flange 401 and bottom flange 402.

As discussed above, first beam 103 comprises first track 133, in which the track element of second cross-link beam 123 slides to fold or unfold building frame module 100. First beam 103 further comprises a bearing 404 and a hole 405 sized and dimensioned to receive a bearing rotatably coupling first beam 103 with first cross-link beam 121. It is contemplated that first hydraulic rod 131 is coupled to bearing 404. As building module 100 folds or unfolds, it is contemplated that first beam 103 remains parallel to the ground.

It is contemplated that first beam 113 can be structurally identical to first beam 103. Thus, first beam 113 can also comprise a modified I-beam shape having a top flange, a bottom flange, a web, a track, a bearing, and a hole as shown in FIGS. 4A-4B.

Figure 5A:
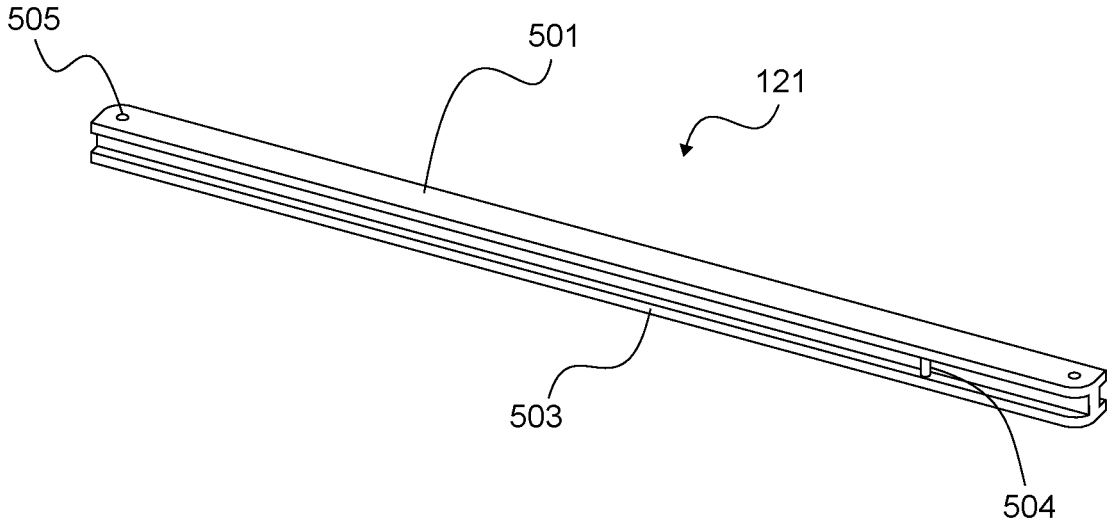
FIG. 5A is a perspective view of the first cross-link beam of the building frame module of FIG. 1A.
Figure 5B:
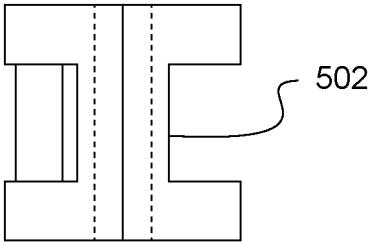
FIG. 5B is an end view of the first cross-link beam of FIG. 5A.

FIGS. 5A-5B show different views of first cross-link beam 121. First cross-link beam 121 has a modified I-beam shape. As shown in FIGS. 5A-5B, first cross-link beam 121 comprises a top flange 501, a bottom flange 503, and a web 502. It is contemplated that first cross-link beam 121 further comprises filleted ends to facilitate rotation. Furthermore, first cross-link beam 121 comprises holes 505 at both ends, so that it is convenient to add bearings afterward for rotation. First cross-link beam 121 further comprises a bearing 504. It is contemplated that a hydraulic rod is coupled to bearing 504. It is further contemplated that one or more of second cross-link beam 123, third cross-link beam 125, and fourth cross-link beam 127 are structurally identical to first cross-link beam 121. Thus, the one or more of second cross-link beam 123, third cross-link beam 125, and fourth cross-link beam 127 can also comprise a modified I-beam shape having a top flange, a bottom flange, a web, a bearing, and holes as shown in FIGS. 5A-5B.

Figure 6A:
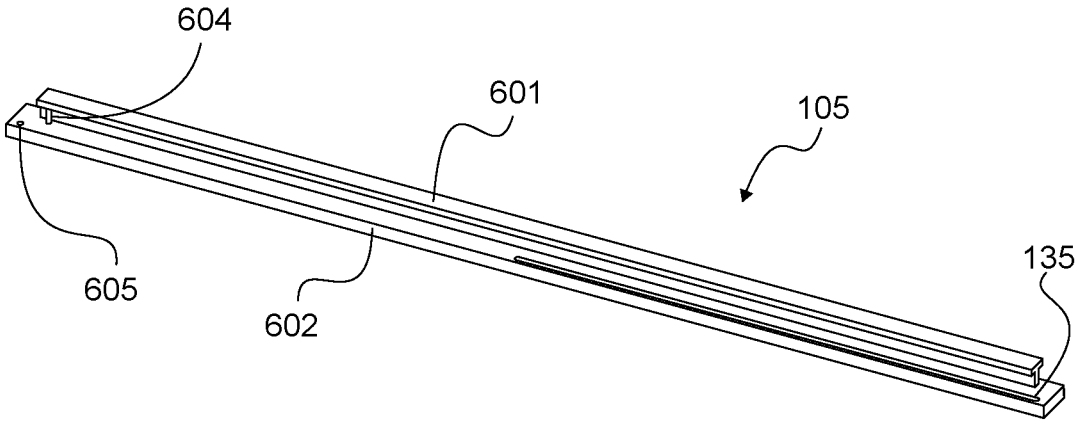
FIG. 6A is a perspective view of the second beam of the first frame component of FIG. 1A.
Figure 6B:
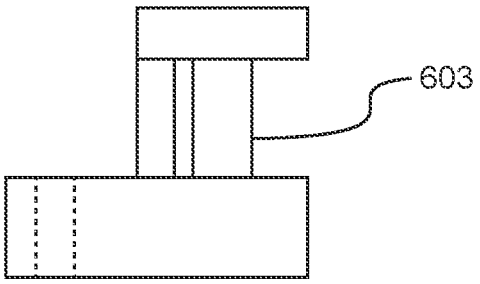
FIG. 6B is an end view of the second beam of FIG. 6A.

FIGS. 6A-6B show different views of second beam 105. As shown in FIG. 1A, second beam 105 is disposed on a bottom of building frame module 100. Second beam 105 also has a modified I-beam shape. Second beam 105 comprises a top flange 601, a bottom flange 602, and a web 603 that extends between top flange 601 and bottom flange 602. As shown in FIG. 6B, bottom flange 602 is thicker and wider than top flange 601. This geometry provides additional strength to second beam 105, which is positioned on a bottom of building frame module 100.

As discussed above, second beam 105 comprises second track 135, in which the track element of third cross-link beam 125 slides as building frame module 100 folds or unfolds. Second beam 105 further comprises a bearing 604 and a hole 605 sized and dimensioned to receive a bearing rotatably coupling second beam 105 with third cross-link beam 125. It is contemplated that a hydraulic rod is coupled to bearing 604.

It is contemplated that second beam 115 can be structurally identical to second beam 105. Thus, second beam 115 can also comprise a modified I-beam shape having a top flange, a bottom flange, a web, a track, a bearing, and a hole as shown in FIGS. 6A-6B.

Figure 7:
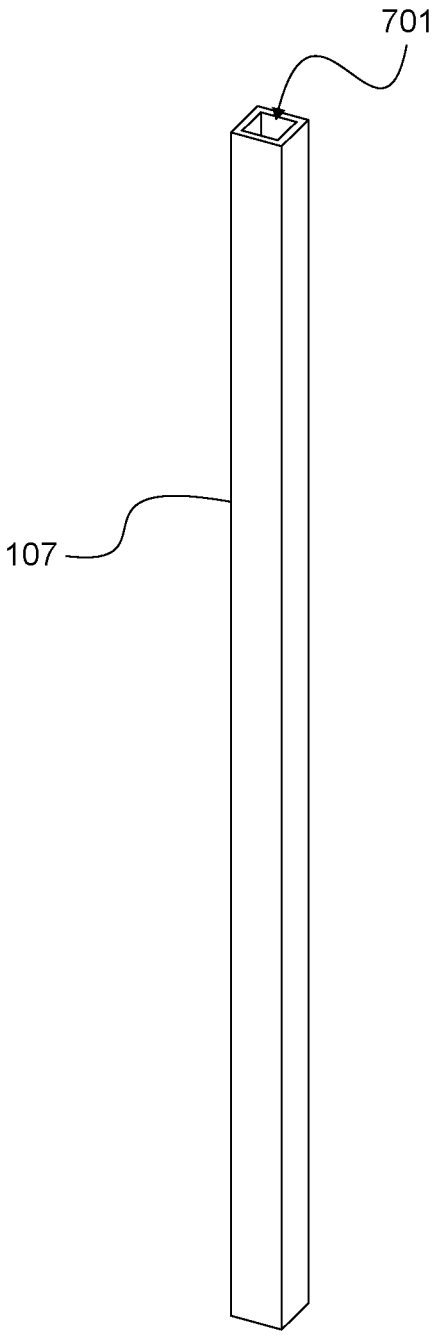
FIG. 7 is a perspective view of the first column of the first frame component of FIG. 1A.

FIG. 7 shows first column 107 having a shell with a hollow cavity 701. First column 107 can be of traditional HSS construction. It is contemplated that one or more of second column 109, first column 117, and second column 119 can be structurally identical to first column 107. First column 107, second column 109, first column 117, and second column 119 support the upper portion of building frame module 100.

Figure 8:
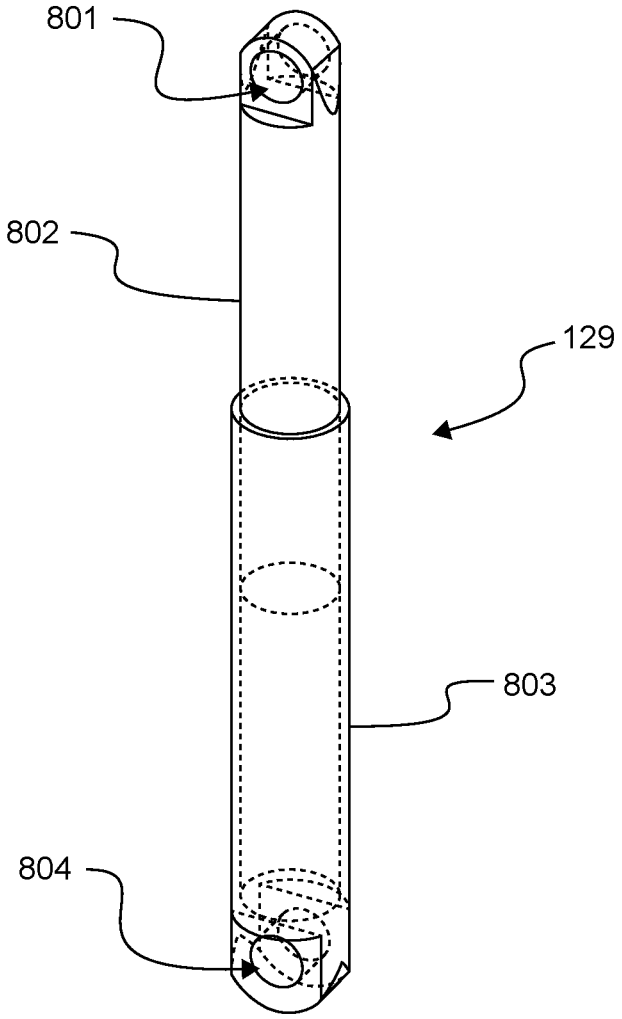
FIG. 8 is a perspective view of the second hydraulic rod of the building frame module of FIG. 1A.

FIG. 8 shows second hydraulic rod 129 having a top opening 801 and a bottom opening 804 that are each sized and dimensioned to receive a bearing. For example, top opening 801 can receive a bearing of fourth cross-link beam 127 and bottom opening 804 can receive bearing 604 of second beam 105. Second hydraulic rod 129 comprises a first rod 802 and a second rod 803. First rod 802 can completely retract into second rod 803, which is filled with hydraulic fluid (e.g., oil). It is contemplated that one or more of the hydraulic rods of building frame module 100 are structurally identical to second hydraulic rod 129. Furthermore, it is contemplated that the hydraulic rods of building frame module 100 can be removed once it is unfolded at the installation site.

Figure 9A:
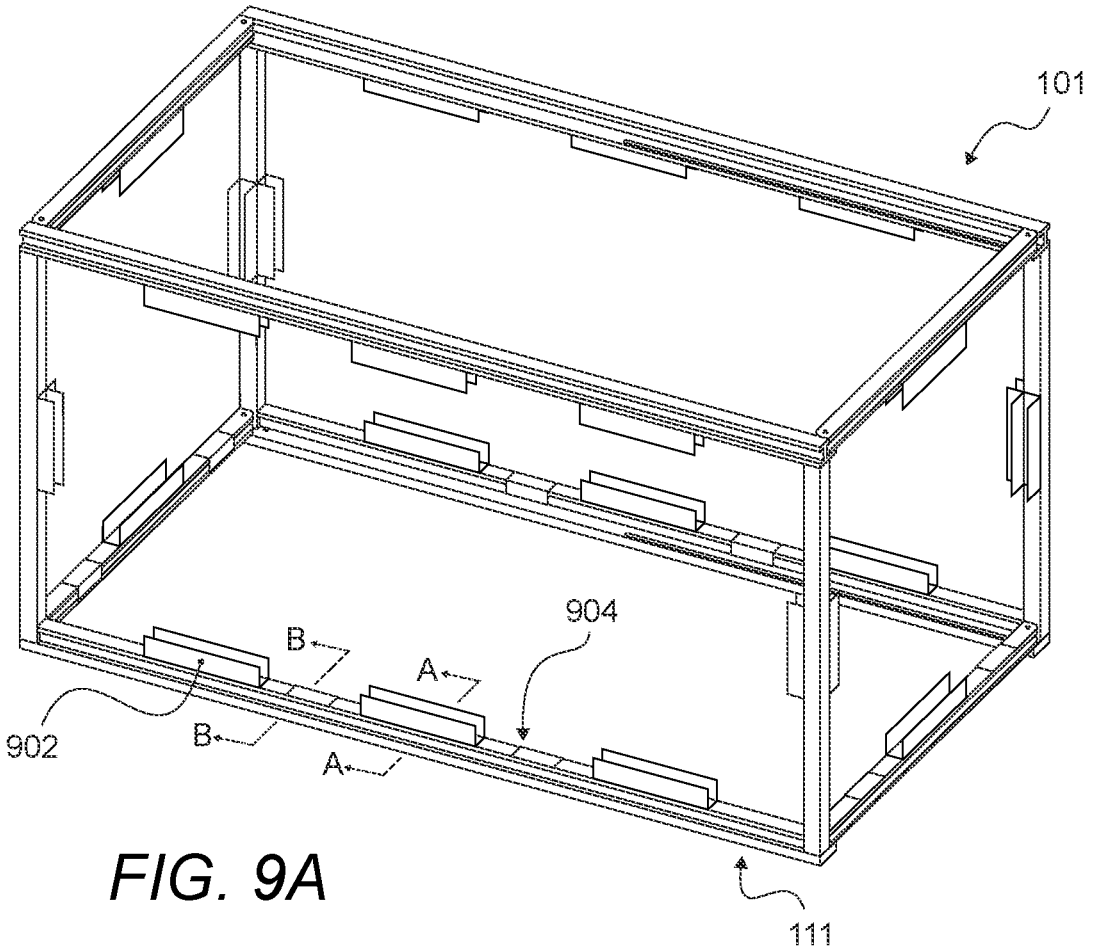
FIG. 9A is a perspective view of the building frame module of FIG. 1A having a plurality of brackets to mount panels.
Figure 9B:
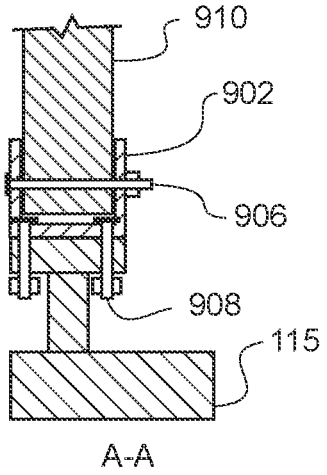
FIG. 9B is a cross-sectional view along A-A in FIG. 9A showing a wall bracket coupled to the building frame module to mount a wall panel.

It should be appreciated that brackets for connecting to walls, ceilings, and floors can be coupled to contemplated building frame modules as shown in FIG. 9A. One or more wall brackets 902 (e.g., steel brackets) can be coupled to first frame component 101, second frame component 111, and the cross-link beams of building frame module 100 as shown in FIG. 9A. More details of a wall bracket 902 are shown in FIG. 9B. One of more fasteners 908 couple wall bracket 902 to building frame module 100. For example, FIG. 9B shows one or more fasteners 908 coupling wall bracket 902 to second beam 115 of second frame component 111. A wall panel 910 can be inserted into bracket and secured via a fastener 906.

Figure 9C:
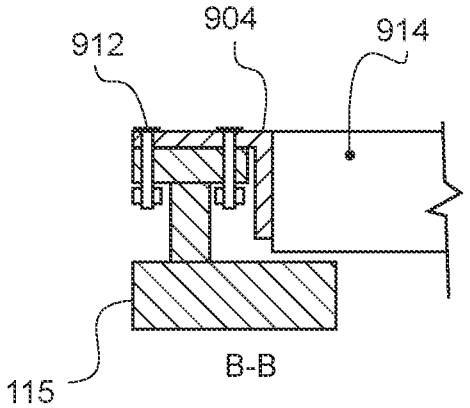
FIG. 9C is a cross-sectional view along B-B in FIG. 9A showing a floor bracket coupled to the building frame module to mount a floor panel.

One or more floor brackets 904 (e.g., steel angles) can be coupled to first frame component 101, second frame component 111, and the cross-link beams of building frame module 100 as shown in FIG. 9A. More details of a floor bracket 904 are shown in FIG. 9C. One of more fasteners 912 couple floor bracket 904 to building frame module 100. For example, FIG. 9C shows one or more fasteners 912 coupling floor bracket 904 to second beam 115 of second frame component 111. A floor panel 914 can be welded or attached to floor bracket 904 via one or more fasteners. It is contemplated that roof brackets have the same shape as the one or more floor brackets 904 to attach a roof panel to the top beams of building frame module 100.

It should be further appreciated that the bearings discussed above can be rotated 90° in one direction in some embodiments. In other embodiments, the bearings discussed above can rotate more than 90° in one direction.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A building frame module, comprising:

a first frame component and a second frame component that each comprise first and second beams coupled to first and second columns;

a first cross-link beam rotatably coupled to the first beam of the first frame component by a first hydraulic cylinder and slidaby coupled to the first beam of the second frame component by a first track element;

a second cross-link beam rotatably coupled to the first beam of the second frame component by a second hydraulic cylinder and slidaby coupled to the first beam of the first frame component by a second track element;

wherein the first beam of the first frame component comprises a first track;

wherein the first beam of the second frame component comprises a second track;

wherein the first track element of the first cross-link beam is configured to move along the second track of the first beam of the second frame component as the first cross-link beam rotates relative to the first beam of the first frame component to thereby move the first frame component toward or away from the second frame component; and wherein the second track element of the second cross-link beam is configured to move along the first track of the first beam of the first frame component as the second cross-link beam rotates relative to the first beam of the second frame component to thereby move the first frame component towards or away from the second frame component.

2. The module of claim 1, further comprising a bearing that provides rotation between the first cross-link beam and the first beam of the first frame component.

3. The module of claim 1, wherein the first hydraulic cylinder is configured to assist in folding and unfolding of the first cross-link beam relative to the first beam of the first frame component.

4. The module of claim 1, wherein the first beam of the second frame component comprises a top flange, a bottom flange, and a web between the top and bottom flanges.

5. The module of claim 4, wherein the first track is disposed on the bottom flange of the first beam of the first frame component.

6. The module of claim 1, wherein the first track of the first beam of the first frame component is a slot, and the second track element of the second cross-link beam is a projection that extends through the slot.

7. The module of claim 1, further comprising a third cross-link beam rotatably coupled to the second beam of the second frame component by a third hydraulic cylinder and slidably coupled to the second beam of the first frame component by a third track element.

8. The module of claim 7, wherein the second beam of the first frame component comprises a third track.

9. The module of claim 8, further comprising a fourth cross-link beam rotatably coupled to the second beam of the first frame component by a fourth hydraulic cylinder and slidably coupled to the second beam of the second frame component by a fourth track element.

10. The module of claim 9, wherein the second beam of the second frame component comprises a fourth track.

11. A modular building frame system, comprising:

a first building frame module comprising first and second frame components, wherein a first cross-link beam is rotatably coupled to the first frame component and slidably coupled to the second frame component, and wherein a second cross-link beam is rotatably coupled to the second frame component and slidably coupled to the first frame component;

a second building frame module comprising first and second frame components, wherein a first cross-link beam is rotatably coupled to the first frame component and slidably coupled to the second frame component, and wherein a second cross-link beam is rotatably coupled to the second frame component and slidably coupled to the first frame component;

a coupling that couples the first building frame module and the second building frame module; and wherein the first and second building frame modules are horizontally or vertically stacked.

12. The system of claim 11, wherein the first and second building frame modules are horizontally stacked, and wherein a beam of the first frame component of the first building frame module abuts a beam of the second frame component of the second building frame module.

13. The system of claim 12, wherein the coupling comprises a plate fastened to the beam of the first frame component of the first building frame module and the beam of the second frame component of the second building frame module.

14. The system of claim 13, further comprising a second plate fastened to a bottom of the beam of the first frame component of the first building frame module and a bottom of the beam of the second frame component of the second building frame module, and wherein the first plate is fastened to a top of the beam of the first frame component of the first building frame module and a top of the beam of the second frame component of the second building frame module.

15. The system of claim 11, wherein the first and second building frame modules are vertically stacked, and wherein a beam of the first frame component of the first building frame module is stacked onto a beam of the second frame component of the second building frame module.

16. The system of claim 15, wherein the coupling extends through a bottom of the beam of the first frame component of the first building frame module and a top of the beam of the second frame component of the second building frame module.

17. The system of claim 16, further comprising a second coupling that extends through the bottom of the beam of the first frame component of the first building frame module and the top of the beam of the second frame component of the second building frame module.

18. The system of claim 11, further comprising a second coupling and a third building frame module comprising first and second frame components and a cross-link beam rotatably coupled to the first frame component and slidably coupled to the second frame component, and further wherein the second coupling couples the third building frame module to the first building frame module or the second building frame module in a horizontally or vertically orientation.

* * * * *